US009297574B2

(12) United States Patent
Lee et al.

(10) Patent No.: US 9,297,574 B2
(45) Date of Patent: Mar. 29, 2016

(54) REFRIGERATOR AND METHOD FOR CONTROLLING THE SAME

(75) Inventors: Dong Hoon Lee, Seoul (KR); Tae Hee Lee, Seoul (KR); Donghoon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 376 days.

(21) Appl. No.: 13/383,000

(22) PCT Filed: Jul. 23, 2010

(86) PCT No.: PCT/KR2010/004858

§ 371 (c)(1),
(2), (4) Date: Jan. 9, 2012

(87) PCT Pub. No.: WO2011/013953

PCT Pub. Date: Feb. 3, 2011

(65) Prior Publication Data

US 2012/0111031 A1 May 10, 2012

(30) Foreign Application Priority Data

Jul. 28, 2009 (KR) ..... 10-2009-0068906

(51) Int. Cl.
*F25C 1/00* (2006.01)
*F25D 23/12* (2006.01)

(52) U.S. Cl.
CPC ..... *F25D 23/126* (2013.01); *F25C 2400/10* (2013.01); *F25C 2400/14* (2013.01); *F25C 2600/04* (2013.01); *F25D 2323/121* (2013.01)

(58) Field of Classification Search
CPC ..... F25C 1/00; F25C 2400/14; F25C 17/042
USPC ..... 62/66, 75, 78, 340, 348
See application file for complete search history.

(56) References Cited

U.S. PATENT DOCUMENTS

| | | | | |
|---|---|---|---|---|
| 3,866,469 | A * | 2/1975 | Wemyss | 73/861.87 |
| 5,549,010 | A * | 8/1996 | Park | B01D 29/114 73/861.79 |
| 5,737,932 | A * | 4/1998 | Lee | 62/135 |
| 6,868,692 | B2 * | 3/2005 | Choi | F25D 23/028 222/146.6 |
| 6,964,177 | B2 * | 11/2005 | Lee | F25C 5/005 62/320 |
| 7,201,005 | B2 * | 4/2007 | Voglewede et al. | 62/126 |
| 7,591,399 | B2 * | 9/2009 | Hortin et al. | 222/144.5 |
| 2006/0027267 | A1 | 2/2006 | Fritze | |
| 2006/0196212 | A1 | 9/2006 | Jenkins et al. | |
| 2007/0089450 | A1 * | 4/2007 | Janardhanam et al. | 62/340 |
| 2009/0069948 | A1 | 3/2009 | Nackers et al. | |
| 2010/0024541 | A1 * | 2/2010 | Schindler | 73/199 |
| 2010/0257875 | A1 * | 10/2010 | Kim | 62/74 |
| 2010/0326096 | A1 * | 12/2010 | Junge | F25C 5/005 62/82 |

OTHER PUBLICATIONS

International Search Report issued in PCT Application No. PCT/KR 2010/004858 dated Oct. 10, 2011.

* cited by examiner

*Primary Examiner* — Jonathan Bradford
*Assistant Examiner* — Elizabeth Martin
(74) *Attorney, Agent, or Firm* — KED & Associates LLP

(57) ABSTRACT

A refrigerator and method of operating a refrigerator are provided in which an amount of water supplied to an ice maker may be accurately controlled. The refrigerator may include an ice maker, a dispenser for dispensing water, a flow passage control valve for selectively guiding water to the ice maker and the dispenser, a flow amount sensor, and a controller operably coupled to the flow amount sensor for controlling an amount of water supplied to the ice maker based on a water supply amount sensed by the flow amount sensor.

7 Claims, 6 Drawing Sheets

REFRIGERATOR AND METHOD FOR CONTROLLING THE SAME

TECHNICAL FIELD

The present disclosure relates to refrigerators, and more particularly, to a refrigerator in which an amount of water supply to an ice maker is controlled accurately for preventing the water from being excessive or deficient, and a method for controlling the same.

BACKGROUND ART

The refrigerator for refrigerated or frozen storage of food is provided with a compressor, a condenser, an evaporator, and an expansion device at a body thereof for driving the same.

The body of the refrigerator has a refrigerating chamber for refrigerated storage and a freezing chamber for frozen storage provided therein, and the evaporator serves to inject cold air into the refrigerating chamber and the freezing chamber.

The refrigerator has doors on fronts of the refrigerating chamber and the freezing chamber respectively, and an ice maker for providing ice and a dispenser for supplying water both mounted to the doors or the refrigerating chamber/the freezing chamber.

The body and the door has water supply pipes provided thereto for guiding water to the ice maker and the dispenser, such that the water moves along the water supply pipes to reach to the ice maker of the dispenser for making the ice or dispensing drinking water.

In order to make the ice, though it is required to supply an exact amount of the water to an ice making tray, in a related art refrigerator, in general cases, the water supply is made to be continuous for a preset time period without calculating or sensing an exact amount of water supply.

DISCLOSURE OF INVENTION

Technical Problem

In the meantime, since there are differences of water pressure from one region to another, if the refrigerator is installed at a region which has a higher or a lower water pressure, there has been a problem in that the amount of water supplied in the preset time period is excessive or deficient.

If the water supply amount to the ice maker exceeds a proper amount of water supply, ice having size bigger than a normal design ice size can be formed, which is not frozen fully, to cause the ice to burst and stuck together in an ice storage box, or distortion of the ice tray, making transfer of the ice from the ice tray difficult in a case of a ice transfer type ice maker.

In the meantime, if the water supply amount is below the proper water supply amount, there have been problems in that defective ice making and difficulty in transferring of the ice have been taken place.

Moreover, there has been a problem in the related art refrigerator in that, if a water dispensing signal is applied to the dispenser in the middle of water supply to the ice maker, making the water to be supplied both to the dispenser and the ice maker, the water is supplied both to the dispenser and the ice maker at flow rates lower than proper water flow rates, respectively.

Solution to Problem

Accordingly, the present disclosure is directed to a refrigerator and a method for controlling the same.

An object of the present disclosure is to provide a refrigerator and a method for controlling the same which can make a water supply amount to an ice maker to be kept at a proper water supply amount regardless of a water pressure of a water supply pipe connected to a refrigerator.

Another object of the present disclosure is to provide a refrigerator and a method for controlling the same which can put priority of water supply to a dispenser for providing convenience to a user even if the user uses the dispenser for taking water in the middle of supply of the water to an ice maker.

Additional advantages, objects, and features of the disclosure will be set forth in part in the description which follows and in part will become apparent to those having ordinary skill in the art upon examination of the following or may be learned from practice of the invention. The objectives and other advantages of the disclosure may be realized and attained by the structure particularly pointed out in the written description and claims hereof as well as the appended drawings.

To achieve these objects and other advantages and in accordance with the purpose of the invention, as embodied and broadly described herein, the refrigerator comprises an ice maker; a dispenser for dispensing water; a flow passage control valve for guiding the water to the ice maker and the dispenser selectively; a flow amount sensor; and a controller connected to the flow amount sensor for controlling a water supply amount to the ice maker taking a water supply amount sensed by the flow amount sensor into account.

The flow amount sensor is mounted to a water supply pipe connected to an inlet to the flow passage control valve.

The flow amount sensor has one outlet arranged upward for preventing bubbles from forming from the water discharged from the flow amount sensor.

The flow amount sensor and the flow passage control valve are mounted to a door of the refrigerator.

The flow amount sensor includes; a body having a space formed therein, an impeller rotatably mounted in the space to have a plurality of blades, a signal generating unit at a tip of one of the plurality of blades, and a signal sensing unit on an inside of the space for sensing a signal from the signal generating unit.

The signal generating unit is a magnet, and the signal sensing unit is a hole sensor for sensing magnetism of the magnet.

The water supply amount is calculated with reference to a number of revolutions of the impeller, wherein counting of a number of revolutions of the impeller is made with reference to a number of times the signal sensing unit senses a signal from the signal generating unit as the impeller rotates.

The controller stops supplying the water to the ice maker if a water dispensing signal is received from the dispenser during supplying the water to the ice maker, and restarts supplying the water to the ice maker by an amount as much as a difference between a preset value and a value the flow amount sensor sensed before stopping of supplying the water to the ice maker if water dispensing at the water dispenser is finished.

According to another aspect of the present invention, a method for controlling a refrigerator comprises the steps of: (a) supplying water to an ice maker; (b) measuring a water supply amount being supplied to the ice maker by using a flow amount sensor; (c) stopping the water supply to the ice maker and supplying the water to the dispenser if an order for dispensing water is received at the dispenser; and restarting the water supply to the ice maker until the water supply amount reaches to a preset value if the water dispensing at the dispenser is finished.

an additional water supply amount in the step (d) is a difference between a preset amount and a water supply amount already made before the water supply to the ice maker is stopped.

It is to be understood that both the foregoing general description and the following detailed description of the present disclosure are exemplary and explanatory and are intended to provide further explanation of the disclosure as claimed.

Advantageous Effects of Invention

As has been described, the a refrigerator and a method for controlling the same of the present disclosure have the following advantages.

The maintenance of the water supply amount to the ice maker at a proper amount regardless of a water supply pressure permits smooth ice making and transfer of the ice made thus.

In a case the dispenser is used for dispensing water in the middle of water supply to the ice maker, by putting priority to the water supply to the dispenser, user's convenience can be provided.

BRIEF DESCRIPTION OF DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

Figure 1:
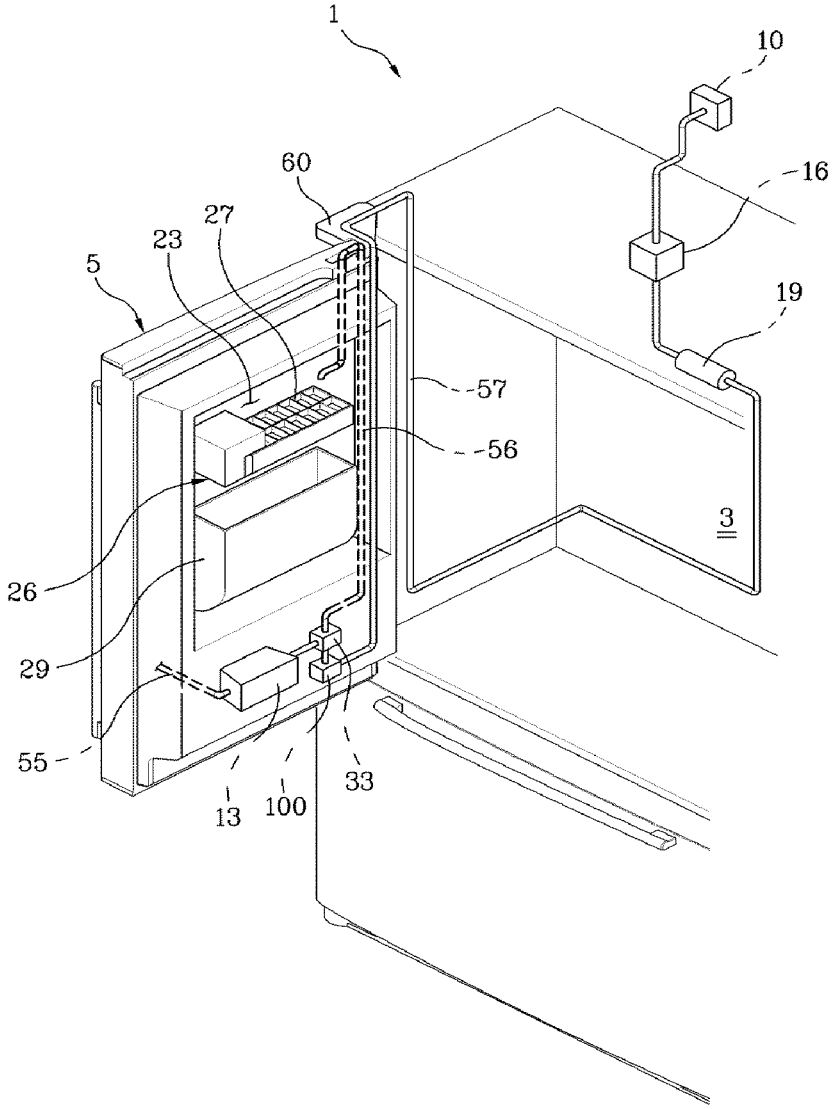
FIG. 1 illustrates a perspective view of a refrigerator in accordance with a preferred embodiment of the present invention.

Referring to FIG. 1, the refrigerator includes a body 1, a storage chamber 3 in the body 1 and a door 5 for opening/closing the storage chamber.

The door 5 is rotatably mounted, and has an ice making chamber 23 for making and storing ice therein, and a dispenser 40 (See FIG. 2) for dispensing water.

In the ice making chamber 23, there are an ice maker 26 for making ice, and an ice storage box 29 for having the ice transferred from the ice maker 26 and stored therein.

Under the ice making chamber 23, there is a water tank 13 provided for cold storage of the water to be supplied to the dispenser 40. On one side of the water tank 13, there is a flow passage control valve 33 for guiding the water to the dispenser or the ice maker 26, selectively.

The flow passage control valve 33 is a three way valve having one outlet connected to the water tank 13, another outlet connected to the ice maker 26.

There is a flow amount sensor 100 mounted to an inlet of the flow passage control valve 33, for calculating a flow amount of the water. The flow amount sensor 100 measures a flow amount of the water being supplied to the ice maker 26 if the flow passage control valve 33 guides the water to the ice maker 26.

The flow amount sensor 100 is mounted to a water supply hose 57 which is connected to an external water supply source 10. Mounted between the flow amount sensor 100 and the external water supply source 10, there are a water supply valve 16 and a filter 19 for filtering the water.

In this instance, the water supply hose 57 is lead along one side of the body 1, passed through a hinge 60 which connects the door 5 to the body 1, lead along one side of the door 5, and connected to the flow amount sensor 100 and the flow passage control valve 33.

Figure 2:
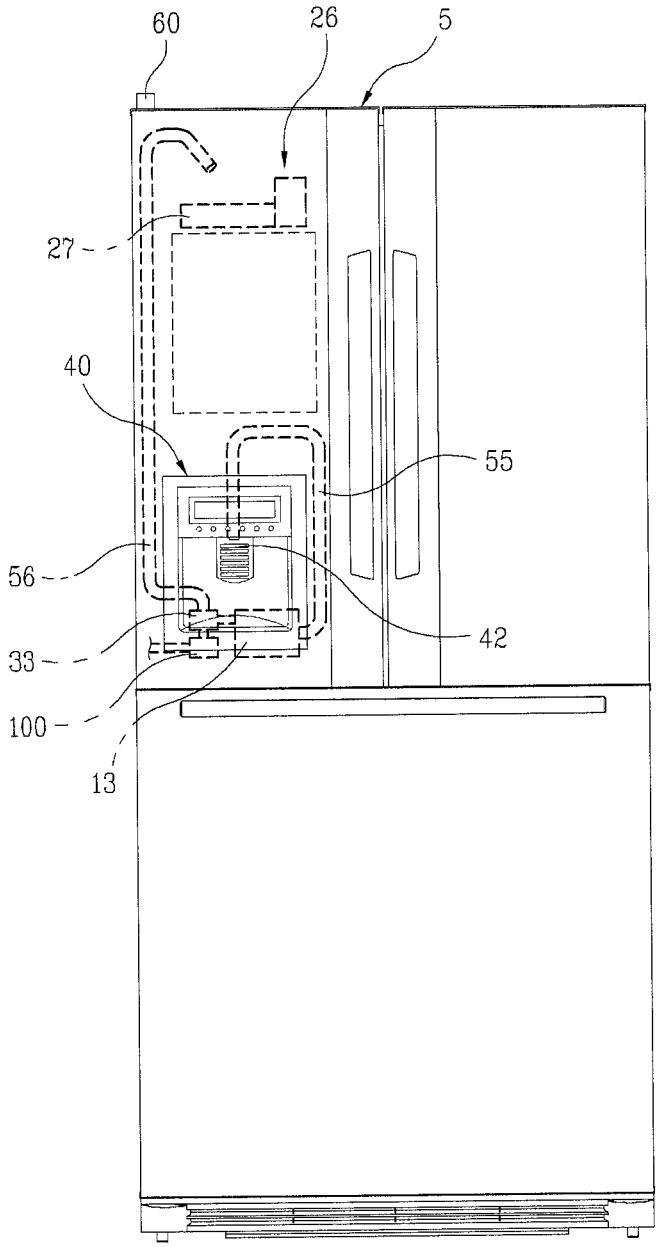
FIG. 2 illustrates a front view of a refrigerator in accordance with a preferred embodiment of the present invention.

There is a first connection hose 55 connected between one of outlets of the flow passage control valve 33 and the water tank 13 and the dispenser 40 (See FIG. 2).

And, there is a second connection hose 56 having one side connected to the other one of outlets of the flow passage control valve 33 and the other side lead upward along one side of the door 5 to supply the water to the ice making tray 27.

In this instance, the ice making chamber 23 is closed by a ice making chamber door (not shown) rotatably mounted to one side wall of the ice making chamber 23, thereby isolating a space in the ice making chamber 23 from the storage chamber 3.

Referring to FIG. 2, the dispenser 40 is mounted to the front of the door 5. The water tank 13, the flow passage control valve 33, and the flow amount sensor 100 are mounted to a rear of the door 5.

As described, if the user presses a water dispensing lever 42 at the dispenser 40, the water, moving toward the dispenser 40, passes through the flow passage control valve 33 and the water tank 13, is discharged from an outlet of the first connection hose 55 over the water dispensing lever 42, and is filled in a container, such as a cup.

In the meantime, the second connection hose 56 branched from the flow passage control valve 33 and lead to the ice maker 26 is arranged along a sidewall of the door 5, with an outlet thereof directed to the ice making tray 27 of the ice maker 26.

Owing to such an arrangement, the water moving toward the ice maker 26 passes through the flow passage control valve 33, falls down to, and is held in, the ice making tray 27.

In a case the water is supplied toward the ice making tray 27, the flow amount sensor 100 is used for measuring the water flow amount to determine if a proper amount of water is supplied or not.

Figure 3:
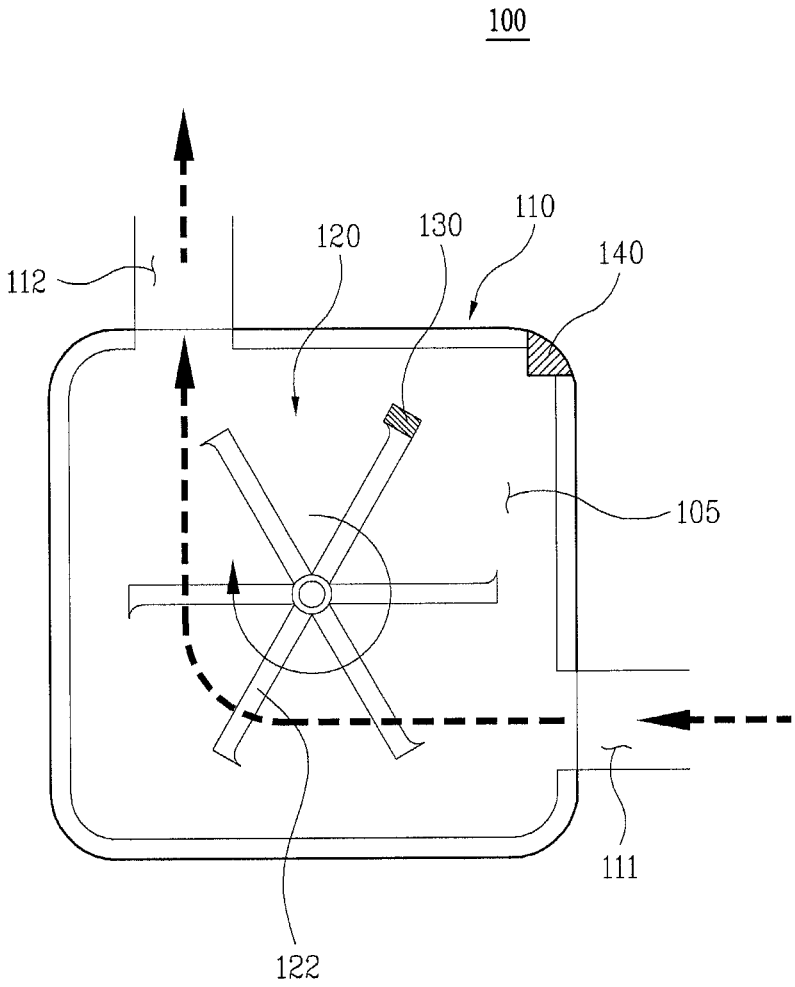
FIG. 3 illustrates a section of a flow amount sensor in accordance with a preferred embodiment of the present invention, schematically.

Referring to FIG. 3, the flow amount sensor includes a body 110 having a space 105 formed therein for introduction of the water thereto and enabling the water to flow therethrough, an impeller 120 having a plurality of blades 122 rotatably mounted in the space 105, a signal generating unit 130 at a tip of one of the plurality of blades 122, and a signal sensing unit 140 on an inside wall of the space 105 for sensing a signal from the signal generating unit 130.

In this instance, it is preferable that the signal generating unit 130 is a magnet and the signal sensing unit 140 is a hall sensor for sensing magnetism of the magnet.

The body 110 has an inlet 111 for introduction of the water and an outlet 112 for discharge of the water, wherein it is preferable that the outlet 112 is at a top side of the body 110 for arranging the outlet 112 to be directed toward an under side of the flow passage control valve 33.

The outlet 112 is arranged thus for preventing bubbles from forming at the time the water is discharged from the outlet 112.

Under this configuration, if the water is introduced to the inlet 111, the water flow rotates the impeller 120 and is discharged through the outlet 112. If the impeller 120 rotates, the signal generating unit at the tip of the blade 122 rotates following the blades 122.

Therefore, if the tip of the blade having the signal generating unit 130 mounted thereto faces the signal sensing unit 140, the signal sensing unit 140 senses presence of the signal generating unit 130.

Then, as the impeller 120 makes one revolution such that the tip of the blade having the signal generating unit 130 mounted thereto faces the signal sensing unit 140 again, the signal sensing unit 140 senses presence of the signal generating unit 130, again.

Owing to this, a controller 200 (See FIG. 4) having the signal sensing unit 140 connected thereto recognizes that the impeller has made one revolution.

In this instance, by multiplying a number of revolutions of the impeller 120 to an amount of the water which induces one revolution of the impeller, the flow amount of the water to the ice maker can be calculated.

Eventually, by comparing a preset water supply amount to be supplied to the ice maker and an amount of the water sensed by the flow amount sensor 100, the water supply to the ice maker may be stopped if the flow amount reaches to the preset water supply amount.

Figure 4:
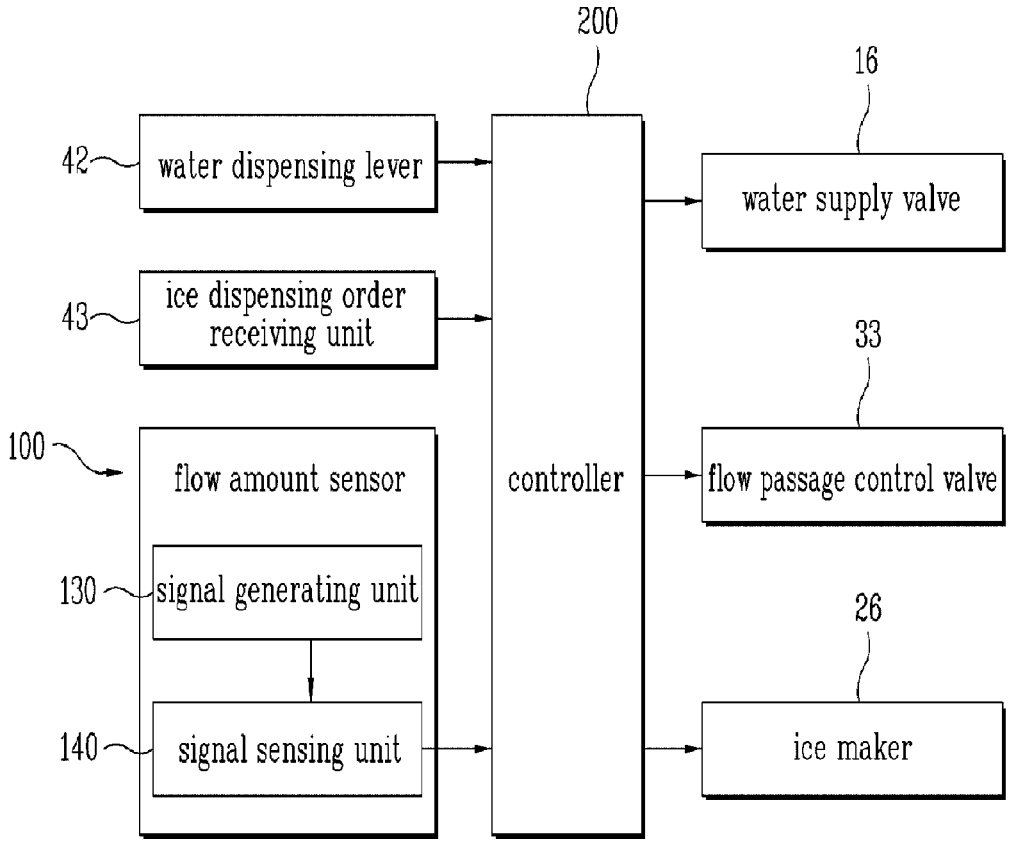
FIG. 4 illustrates a block diagram showing control of a refrigerator in accordance with a preferred embodiment of the present invention.
Figure 5:
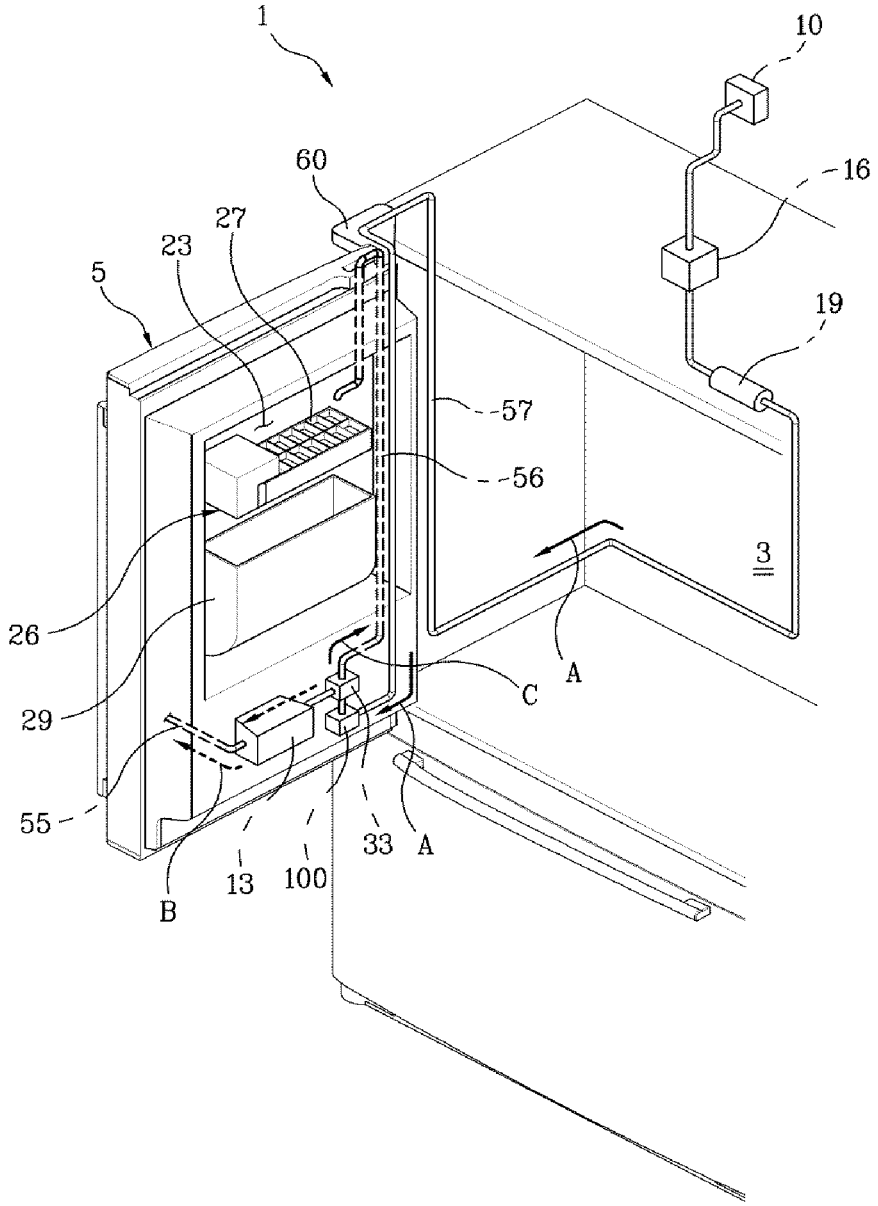
FIG. 5 illustrates a perspective view of a refrigerator in accordance with a preferred embodiment of the present invention, showing a water flow.
Figure 6:
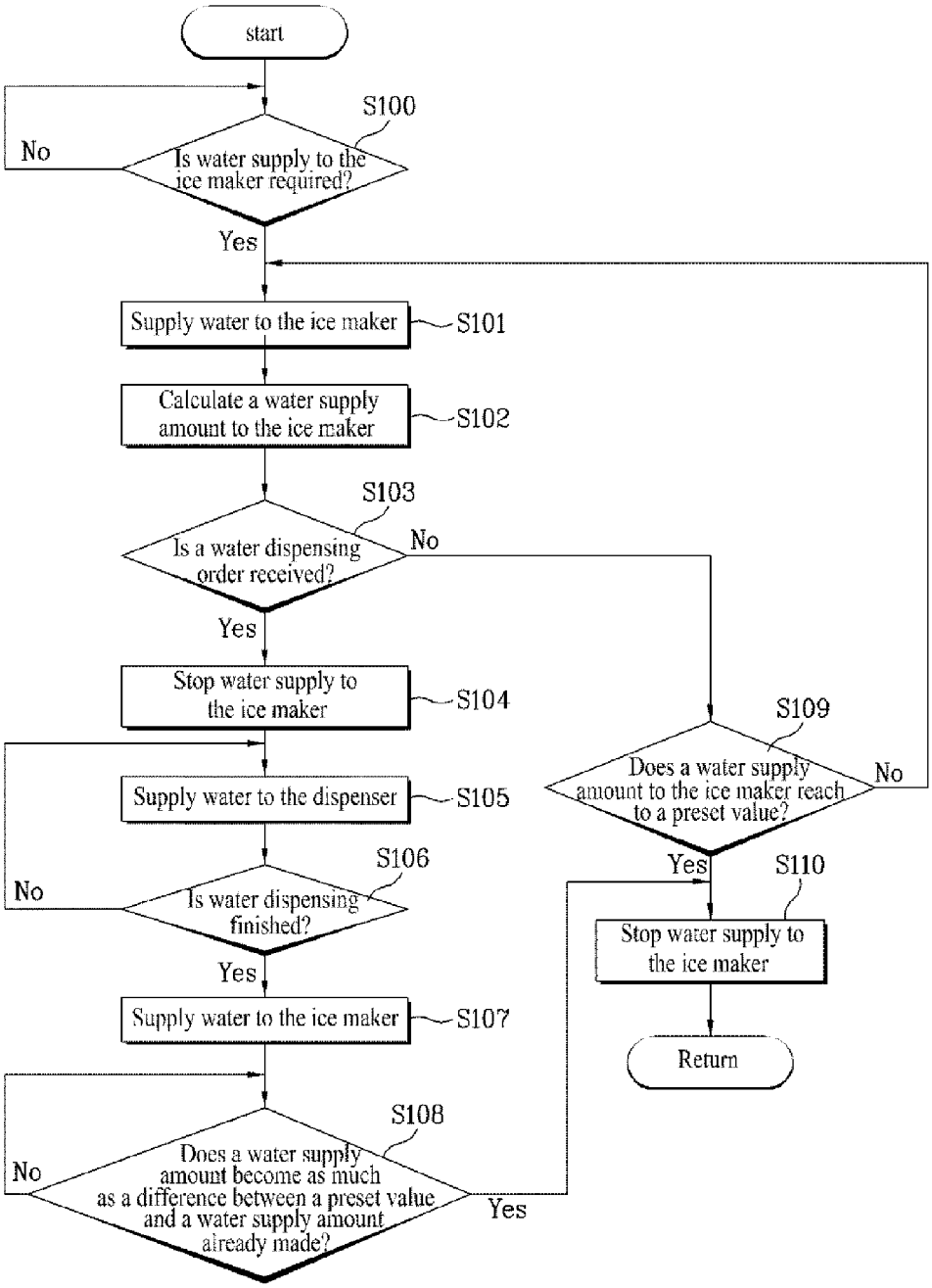
FIG. 6 illustrates a flow chart showing the steps of a method for controlling a refrigerator in accordance with a preferred embodiment of the present invention.

Referring to FIG. 4, the controller 200 has the water dispensing lever 42, an ice dispensing order receiving unit 43 for receiving an order to dispense the ice, and the flow amount sensor 100 connected to an input terminal thereof.

Of the signal generating unit 130 and the signal sensing unit 140 of the flow amount sensor 100, the signal sensing unit 140 is connected to the controller 200.

The controller 200 has the water supply valve 16, the flow passage control valve 33 and the ice maker 26 connected to an output terminal thereof. Therefore, once the water dispensing lever 42 is put into operation, the water supply valve 16 is operated to supply the water, and the flow passage control valve 33 is operated to guide a direction of water flow to the dispenser 40 to dispense the water.

In the meantime, if the user applies an order to the ice dispensing order receiving unit 43, the controller 200 controls such that the ice moves from the ice storage box 29 (See FIG. 1) to the dispenser 40. If there is no ice in the ice storage box 29, the controller 200 puts the ice maker 26 into operation to transfer the ice to the ice box 29, then therefrom to the dispenser 40.

The controller 200 also controls such that, if the user presses the water dispensing lever 42 in the middle of water supply to the ice maker 26, an open direction of the flow passage control valve 33 is switched from the ice maker 26 to the dispenser 40 to supply the water to the dispenser 40.

If the water supply to the dispenser 40 is finished, the controller 200 switches the open direction of the flow passage control valve 33 to the ice maker 26 again to supply the water to the ice maker 26, additionally.

In this instance, the additional water supply is made as much as a difference of water supply amounts between the preset water supply amount to be supplied to the ice maker 26 and the water supply amount made already measured by the flow amount sensor 100.

The operation of the present disclosure will be described with reference to the attached drawings.

In the refrigerator of the present invention, it is not preferable to supply the water both to the ice maker 26 and the dispenser 40 at a time.

Since two direction water supply is against the user's requirement of quick supply of the water to the ice maker or quick dispensing of the water to the dispenser while a water supply rate is fixed.

At first, neither water supply to the ice maker nor water dispensing at the dispenser is required, the water supply valve is at a turned off state maintaining no water flow to the water supply hose 57.

In the meantime, if a water supply request signal is generated for making ice at the ice maker 26, the water supply valve 16 becomes a turned on state to open the water supply valve 16, and the flow passage control valve 33 switches a water supply direction to the ice maker 26.

Then, the water, passed through the water supply valve 16, flows into the ice making tray 27 of the ice maker 26 along the second connection hose 56 via the flow amount sensor 100 and the flow passage control valve 33 (A and C directions).

In this instance, the flow passage control valve 33 measures a water supply amount to the ice maker 26, and, if the water supply amount reaches to the preset water supply amount, the controller 200 turns the water supply valve 16 into a turn off state to stop the water supply to the ice maker 26.

In the meantime, if a water dispensing signal is received from the water dispensing lever 42, the controller 200 turns on the water supply valve 16, and switches the water supply direction of the flow passage control valve 33 to the dispenser 40.

According to this, the water, passed through the water supply valve 16, moves to the dispenser 40 along the water supply hose 55 via the flow amount sensor 100 and the flow passage control valve 33, and therefrom to an outside of the dispenser 40 (A and B directions).

In the meantime, a case when the water dispensing signal is received in the middle of water supply to the ice maker will be reviewed.

At first, the controller determines whether water supply to the ice maker is required or not S100, if determined yes, the water supply to the ice maker is performed (S101).

The controller calculated the water supply amount to the ice maker by using the signal sensing unit 140 while performing the water supply (S102).

And, the controller 200 determines whether an water dispensing order is received or not through the dispenser (S103), and if determined yes, the water supply to the ice maker is stopped (S104).

And, the controller switches the open direction of the flow passage control valve 33 to the dispenser, to supply the water to the dispenser.

Thereafter, the controller determines whether water dispensing at the dispenser is finished or not (S106), and, if determined yes, restarts the water supply to the ice masker (S107).

While performing the water supply to the ice maker, the controller determines whether the water supply amount being made presently is as much as a difference of water amounts between the preset value required supplying for ice making and the water supply amount already made before the water supply to the ice maker is stopped (S108).

And, the controller stops the water supply to the ice maker if the water supply is as much as the difference of the water supply.

That is, for an example, if the preset amount required for ice making is 400 ml, and the water supply amount to the ice maker made before water supply to the ice maker is 250 ml, the controller determines whether an additional water supply amount is 150 ml or not, and, if the additional water supply amount is less than 150 ml, keeps the water supply and, if the additional water supply amount is reached to the 150 ml, stops the water supply to the ice maker.

Eventually, if the water supply to the ice maker is made thus, not supply the water for a preset time period, but measuring the water supply amount to the ice maker, excessive or short supply of the water to the ice maker can be reduced.

Moreover, the turning off of the water supply to the ice maker at the time dispenser is in operation, permitting concentration of the water supply onto the dispenser, makes quick water dispensing at the dispenser.

And, in a case the water dispensing is finished and the water supply to the ice maker restarts, by making the water supply as much as the additional water supply amount, even if the water supply to the dispenser and the water supply to the ice maker alternate, a required amount of water can be supplemented to the ice maker.

It will be apparent to those skilled in the art that various modifications and variations can be made in the present disclosure without departing from the spirit or scope of the inventions. Thus, it is intended that the present disclosure covers the modifications and variations of this disclosure provided they come within the scope of the appended claims and their equivalents.

The invention claimed is:

1. A refrigerator, comprising:

a cabinet having a storage chamber;

a door to open or close the storage chamber;

a flow passage provided in the cabinet and connected from an external water supply source, the flow passage passing a hinge of the door;

a filter connected to the flow passage within the storage chamber for filtering water;

an ice maker provided in the door;

a flow amount sensor provided in the door and connected from the flow passage;

a dispenser provided in the door for dispensing water;

a flow passage control valve connected from the flow amount sensor and provided at a branch point of a hose connected to the ice maker and the dispenser for selectively guiding water to the ice maker and the dispenser, the flow amount sensor being mounted to a water supply pipe, the water supply pipe being between the flow amount sensor and the flow passage control valve; and a controller provided in the door, connected to the flow amount sensor and configured to control an amount of water supplied to the ice maker based on a water supply amount sensed by the flow amount sensor, wherein the flow amount sensor comprises an inlet at a sideward side and an outlet at an upward side for preventing bubbles from forming due to water discharged from the flow amount sensor.

2. The refrigerator as claimed in claim 1, wherein the flow amount sensor and the flow passage control valve are mounted at the door.

3. The refrigerator as claimed in claim 1, wherein the flow amount sensor comprises:

a body having a space formed therein;

an impeller rotatably provided in the space, the impeller including a plurality of blades;

a signal generator provided at a tip of one of the plurality of blades; and a signal sensor provided on an inside of the space for sensing a signal from the signal generator.

4. The refrigerator as claimed in claim 3, wherein the signal generator is a magnet, and the signal sensor is a Hall sensor for sensing magnetism of the magnet.

5. The refrigerator as claimed in claim 3, wherein the water supply amount is calculated based on a number of revolutions of the impeller, wherein a number of revolutions of the impeller is determined based on a number of times the signal sensor senses a signal from the signal generator as the impeller rotates.

6. The refrigerator as claimed in claim 1, wherein the flow passage control valve is a three-way valve.

7. The refrigerator as claimed in claim 1, wherein the controller is configured to stop supplying water to the ice maker in response to a water dispensing signal received from the dispenser while supplying water to the ice maker, the controller is configured to calculate a value of an amount of water supplied to the ice maker, and the controller is configured to resume supplying water to the ice maker by an amount as much as a difference between a preset value and the calculated amount value when water dispensing at the water dispenser is completed.

* * * * *